US011699367B1

(12) United States Patent
Phagura et al.

(10) Patent No.: US 11,699,367 B1
(45) Date of Patent: Jul. 11, 2023

(54) SMART DISPLAY FOR TRAILER DOOR OR PANEL

(71) Applicants: Ranjit Singh Phagura, Lodi, CA (US); Racinder S. Uppal, Acampo, CA (US)

(72) Inventors: Ranjit Singh Phagura, Lodi, CA (US); Racinder S. Uppal, Acampo, CA (US)

( * ) Notice: Subject to any disclaimer, the term of this patent is extended or adjusted under 35 U.S.C. 154(b) by 0 days.

(21) Appl. No.: 17/672,920

(22) Filed: Feb. 16, 2022

(51) Int. Cl.
*G09F 21/04* (2006.01)
*G09F 9/33* (2006.01)
*G09F 7/18* (2006.01)
*G09F 13/22* (2006.01)

(52) U.S. Cl.
CPC ..... *G09F 21/048* (2013.01); *G09F 7/18* (2013.01); *G09F 9/33* (2013.01); *G09F 13/22* (2013.01); *G09F 2007/1865* (2013.01); *G09F 2013/222* (2013.01); *G09F 2013/227* (2013.01)

(58) Field of Classification Search
CPC . G09F 21/048; G09F 7/18; G09F 9/33; G09F 13/22; G09F 2007/1865; G09F 2013/222; G09F 2013/227
See application file for complete search history.

(56) References Cited

U.S. PATENT DOCUMENTS 3,802,103 A * 4/1974 Neff ..... G09F 21/04 40/606.15
5,949,581 A * 9/1999 Kurtenbach ..... G09F 9/33 359/623
10,412,800 B1 * 9/2019 Beattie ..... H04L 67/12
2003/0217495 A1 * 11/2003 Nagamine ..... G09F 9/33 40/605
2008/0030427 A1 * 2/2008 Lanham ..... G09F 21/042 345/2.3
2008/0084360 A1 * 4/2008 Shingai ..... G09F 21/048 345/1.3
2009/0019747 A1 * 1/2009 Rosa ..... G09F 21/04 40/590
2009/0019748 A1 * 1/2009 Rosarius ..... G09F 21/04 40/591
2009/0211132 A1 * 8/2009 Rosa ..... G09F 21/04 40/606.01
2010/0042285 A1 * 2/2010 Abernethy, Jr. ..... G09F 21/048 701/31.4
2013/0231828 A1 * 9/2013 Seal ..... G09F 19/18 701/36
2014/0338237 A1 * 11/2014 Chu ..... G09F 21/04 40/452
(Continued)

*Primary Examiner* — Gary C Hoge
(74) *Attorney, Agent, or Firm* — Craig A. Simmermon

(57) ABSTRACT

A smart display screen that is reversibly rigidly attachable to a door or panel of a semi truck trailer. The smart display screen is linked to a computer and wireless modem that is built into a special frame and cabinet that is reversibly rigidly attachable to a door or panel on a semi truck trailer. The smart display screen is used to display motion video advertisements and still frame advertisements that are seen by other drivers on the road or highway. The special frame and cabinet is reversibly rigidly attachable to a door or panel of a trailer using the special mechanical clamping mechanism which allows the smart display to be easily installed onto any existing trailer door or panel by simply cutting a rectangular hole in the trailer door or panel and then installing the special frame and cabinet.

4 Claims, 6 Drawing Sheets

(56) References Cited

U.S. PATENT DOCUMENTS

| | | | | |
|---|---|---|---|---|
| 2015/0187237 | A1* | 7/2015 | Hall | G09F 9/33 29/825 |
| 2016/0210886 | A1* | 7/2016 | Brashnyk | F16M 11/041 |
| 2019/0213931 | A1* | 7/2019 | Brubaker | B60Q 1/44 |
| 2020/0402480 | A1* | 12/2020 | Ueda | G09G 5/00 |
| 2021/0150948 | A1* | 5/2021 | Zubic | G09F 21/048 |
| 2021/0358347 | A1* | 11/2021 | Jiang | G09F 9/3026 |
| 2022/0037296 | A1* | 2/2022 | Yeon | H01L 25/167 |
| 2022/0048440 | A1* | 2/2022 | Hockly | G09F 9/30 |
| 2022/0101381 | A1* | 3/2022 | Terzian | G06Q 30/0246 |
| 2022/0108638 | A1* | 4/2022 | Schuettke | G09F 9/3026 |
| 2022/0169272 | A1* | 6/2022 | Jablovski | B60W 50/14 |
| 2022/0208035 | A1* | 6/2022 | Weihmann | G09F 21/048 |
| 2022/0217856 | A1* | 7/2022 | Li | G09F 7/20 |

* cited by examiner

SMART DISPLAY FOR TRAILER DOOR OR PANEL

DESCRIPTION

BACKGROUND OF THE INVENTION

1. Field of the Invention

This invention relates to a smart display screen that is attached to a door or panel of a semi truck trailer. Specifically, this invention is a smart display screen linked to a computer and wireless modem that is built into a special frame and cabinet that is reversibly rigidly attachable to a door or panel on a semi truck trailer. The smart display screen is used to display motion video advertisements and still frame advertisements wherein these advertisements are seen by other drivers on the road or highway.

2. Description of Related Art

There have been other display screens attached to a truck or a trailer in the prior art, however, there are no display screens in the prior art with the electronic and computer capabilities as shown and described below that are encased into a special frame and cabinet that is reversibly rigidly attachable to a door or panel of a trailer using the special mechanical clamping mechanism as shown and described below. The special frame and cabinet with special mechanical clamping mechanism allows this invention to be easily installed onto any existing trailer door or panel by simply cutting a rectangular hole in the trailer door or panel and then installing the special frame and cabinet as described below. The special frame and cabinet also protects the delicate electronic, computer, and lighting components of this invention to provide safe and dependable functionality of the smart display.

BRIEF SUMMARY OF THE INVENTION

It is an aspect of smart display for trailer door or panel to be reversibly rigidly attachable to a door or panel of a trailer.

It is an aspect of smart display for trailer door or panel to include at least one LED panel containing a plurality of LED or light emitting diodes.

It is an aspect of smart display for trailer door or panel to include a computer.

It is an aspect of smart display for trailer door or panel to include a video processing module.

It is an aspect of smart display for trailer door or panel to include a sending card integrated circuit card or relay card integrated circuit card.

It is an aspect of smart display for trailer door or panel to include a special frame and cabinet that is reversibly rigidly attachable to a door or panel of a trailer.

It is an aspect of the special frame and cabinet to include a special mechanical clamping mechanism to securely reversibly attach the smart display for trailer door or panel to a trailer door or panel on the trailer.

It is an aspect of smart display for trailer to display advertisements including motion video advertisements and still frame advertisements.

It is an aspect of smart display for trailer to display the reproduction or live broadcasting of visual images or video content.

It is an aspect of smart display for trailer to network with or wirelessly connect to a central computer or a mother server while the smart display for trailer is attached to a trailer and in motion on the roads or highways.

DEFINITION LIST

Figure 1:
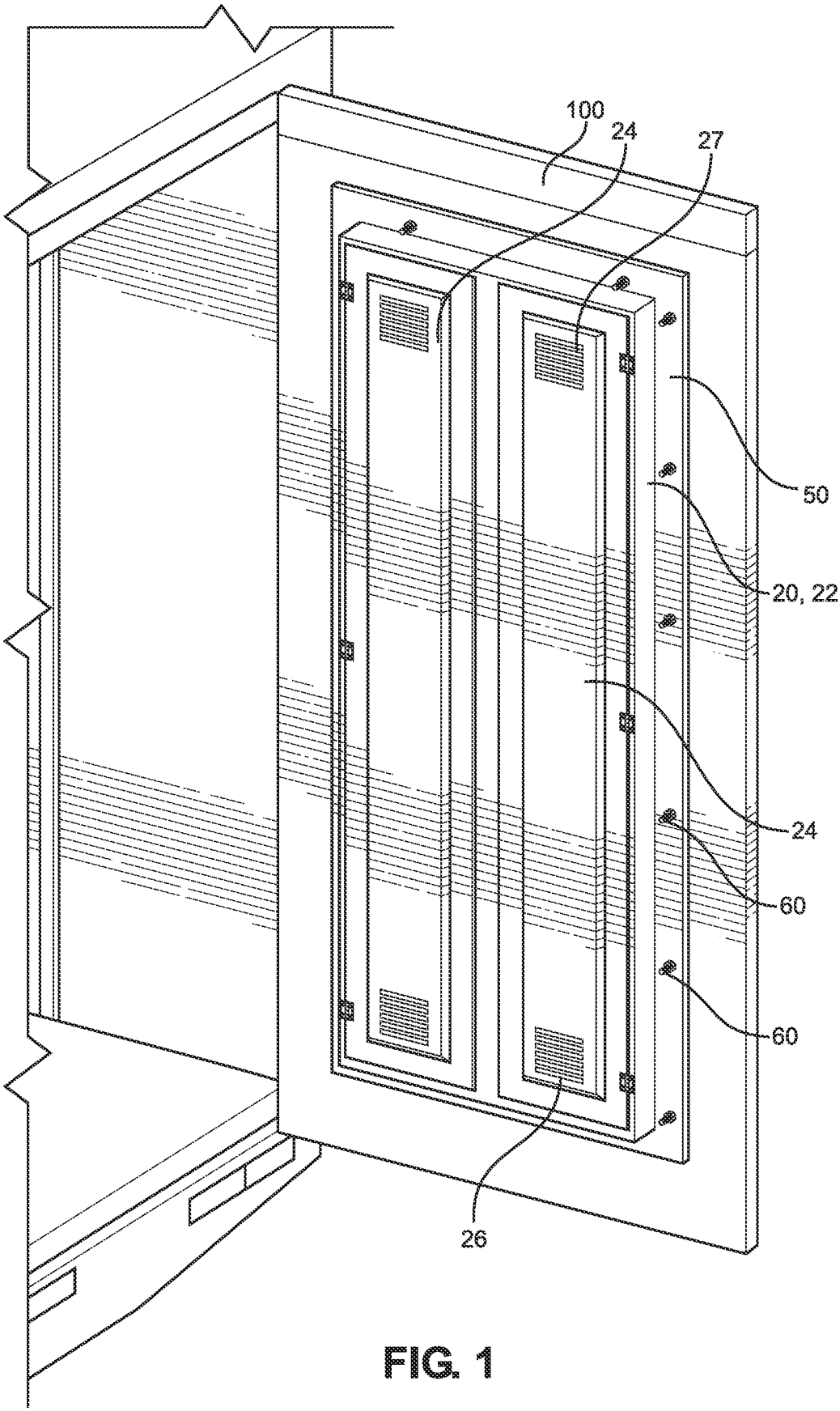
FIG. 1 is perspective view of the inside of a trailer door or panel with a smart display for trailer door or panel attached to the trailer door or panel.
Figure 2:
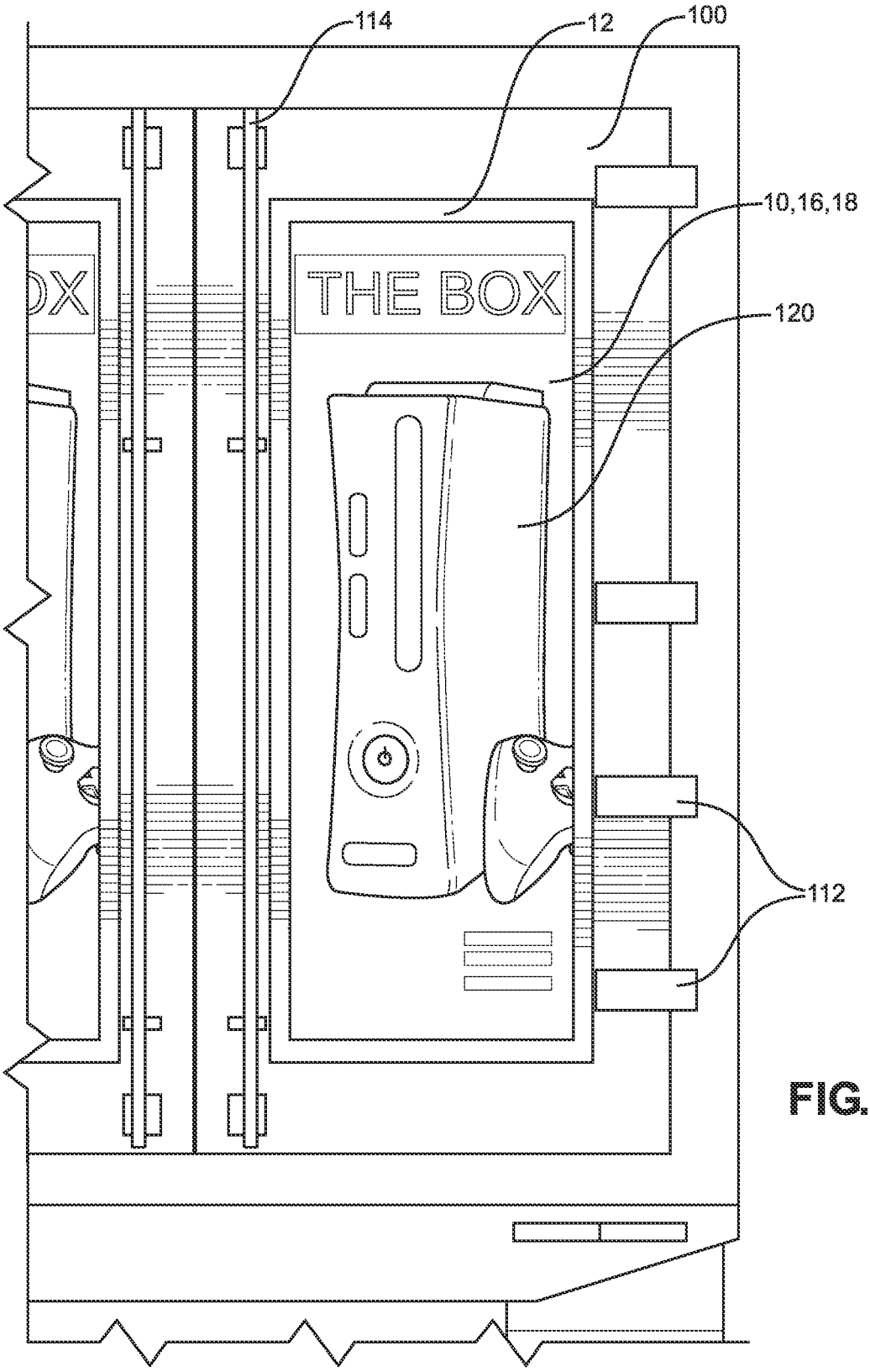
FIG. 2 is a perspective view of the outside of a trailer door or panel with a smart display for trailer door or panel attached to a trailer door or panel with an advertisement on the display screen of the smart display for trailer door.
Figure 3:
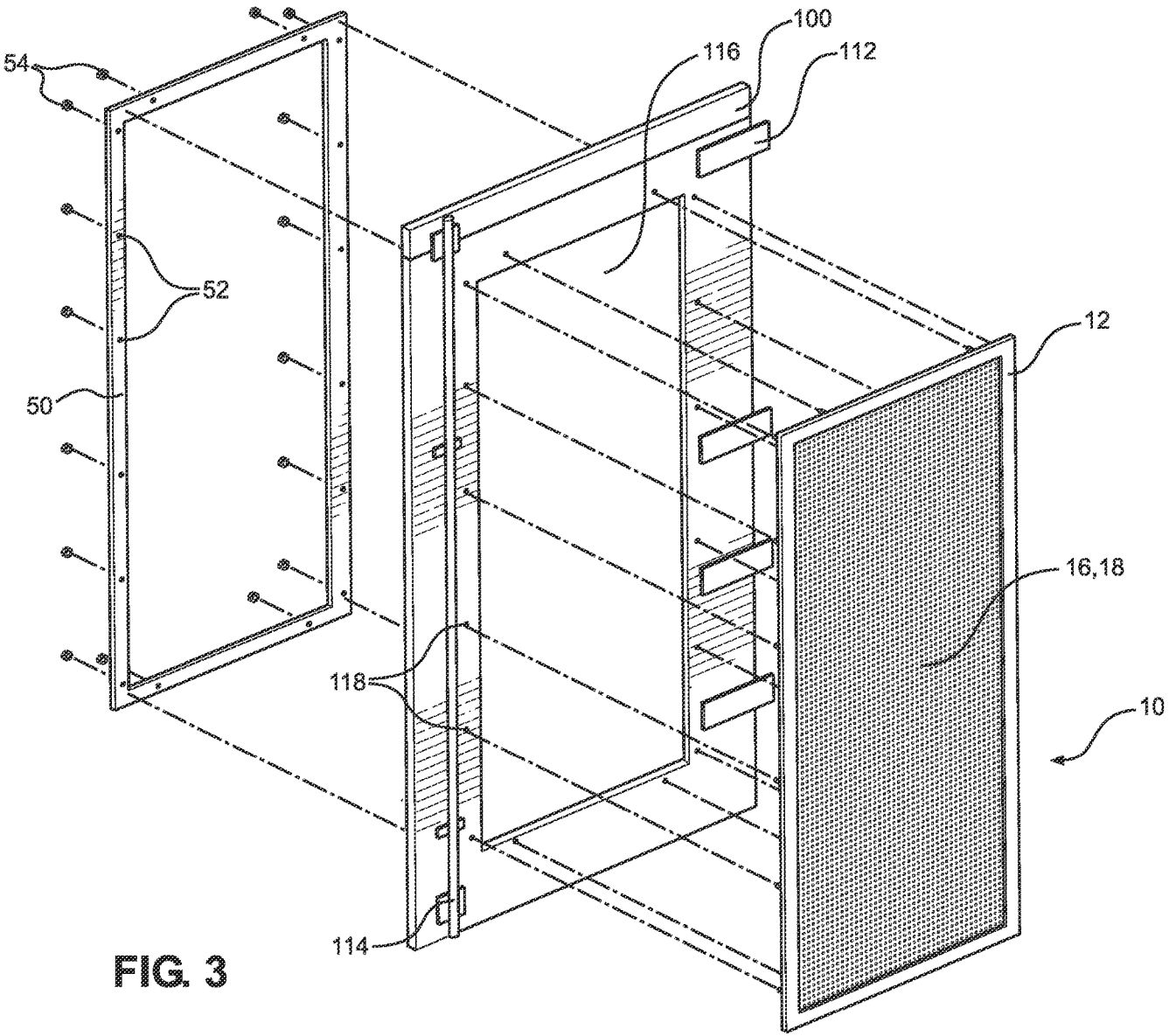
FIG. 3 is an assembly view taken from the exterior of the trailer of a smart display for trailer door or panel attached to a trailer door or panel.
Figure 4:
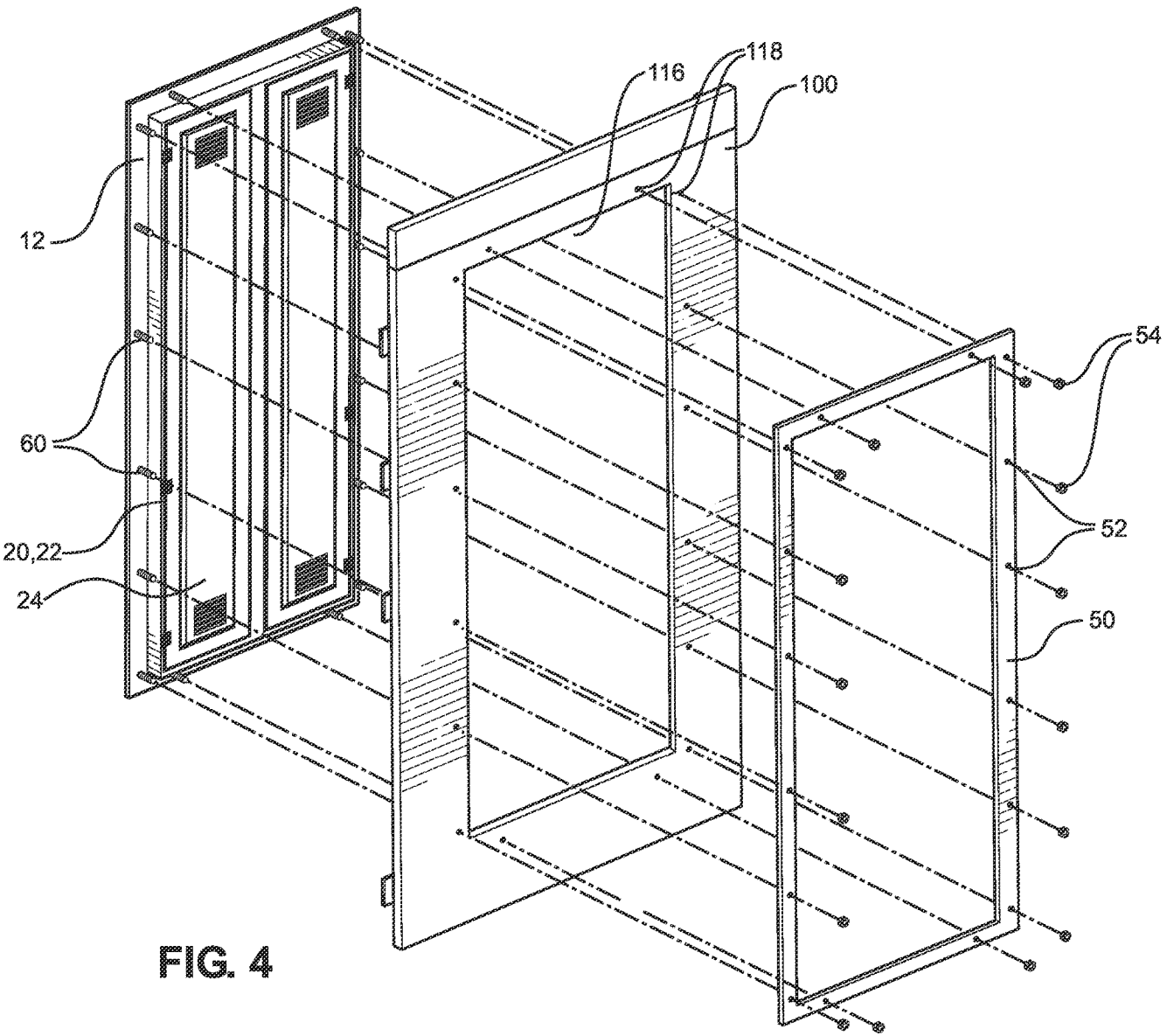
FIG. 4 is an assembly view taken from the interior of the trailer of a inside of a smart display for trailer door or panel attached to a trailer door or panel.
Figure 5:
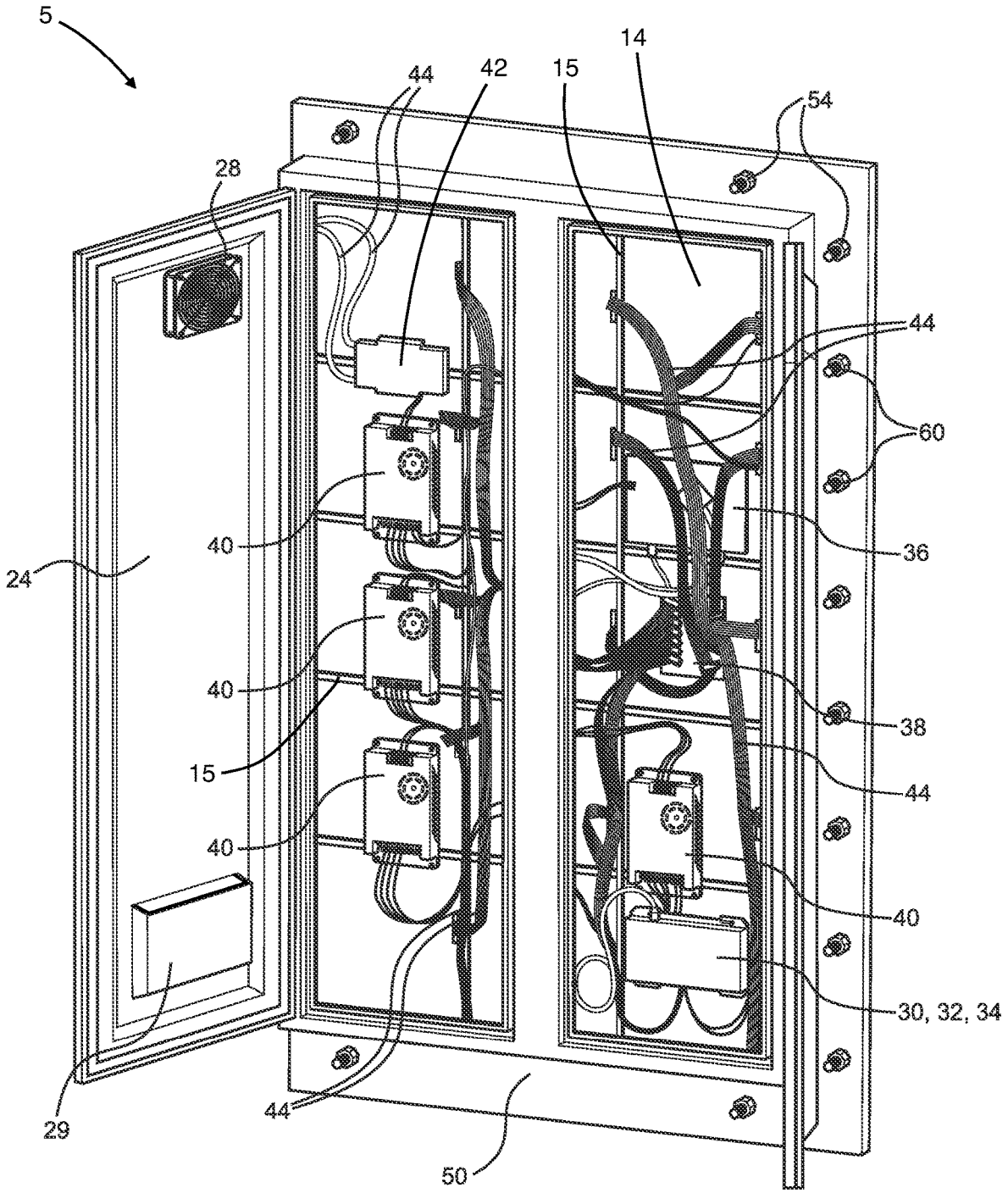
FIG. 5 is perspective view of the interior side of a smart display for trailer door or panel with the cabinet doors open, depicting the electronic components inside.
Figure 6:
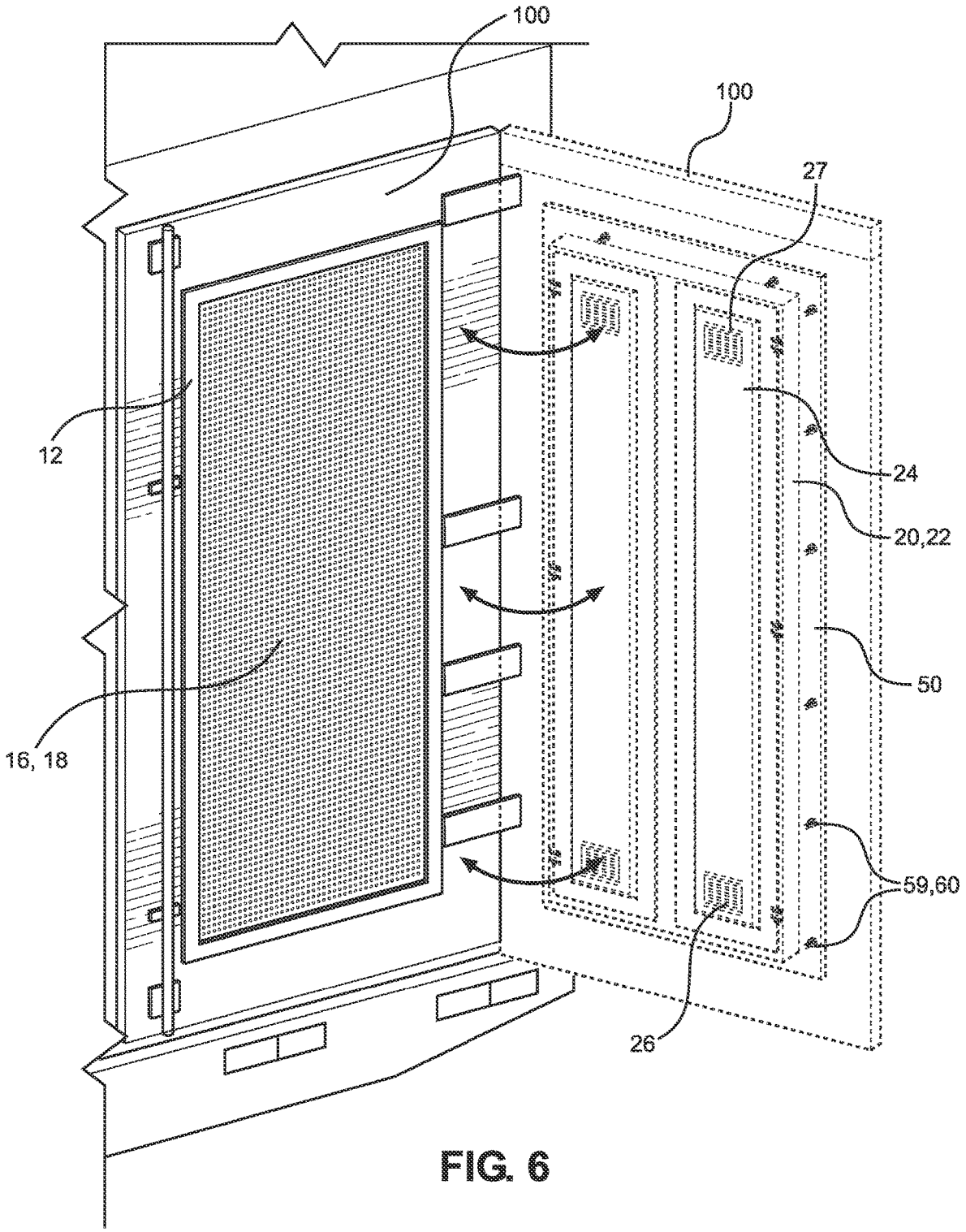
FIG. 6 is a perspective view of a smart display for trailer door or panel attached to a trailer door with the trailer door closed in solid lines and the trailer door open in dashed lines.

| Term | Definition |
|---|---|
| 5 | Smart Display for Trailer Door or Panel |
| 10 | Display Screen |
| 12 | Frame |
| 14 | Frame Mounting Panel |
| 15 | Support Rib |
| 16 | LED Panel |
| 18 | LED Light on LED Panel 16 |
| 20 | Cabinet |
| 22 | Cabinet Box |
| 24 | Cabinet Door |
| 26 | Lower Vent |
| 27 | Upper Vent |
| 28 | Fan |
| 29 | Air Box |
| 30 | Computer |
| 32 | Wireless Modem |
| 34 | GPS Tracking Unit |
| 36 | Video Processing Module |
| 38 | Sending Card or Relay Card Module |
| 40 | LED Panel Power Supply |
| 42 | Power Junction Box |
| 44 | Electrical Wiring or Cable |
| 50 | Retaining Flange |
| 52 | Bolt, Stud, or Rivet Hole |
| 54 | Retaining Flange Nut |
| 60 | Bolt, Stud, or Rivet |
| 100 | Trailer Door or Panel |
| 112 | Trailer Door Hinge |
| 114 | Trailer Door Latch |
| 116 | Rectangular Hole or Window in Trailer door or Panel |
| 118 | Stud Hole in Trailer Door or Panel |
| 120 | Advertisement |

DETAILED DESCRIPTION OF THE INVENTION

Smart display for trailer door or panel 5 is a self-contained unit that is reversibly rigidly attachable to a trailer door or panel 100. Trailer door or panel 100 is a door or panel on a trailer that is towed by a truck, a semi truck, a semi tractor trailer truck, or a big rig truck. Most retail goods are transported to market by truck, semi truck, semi tractor trailer truck, or big rig truck that tows a trailer, wherein the retail goods are stowed. Smart display for trailer door or panel 5 is reversibly attachable to the trailer door or panel 100 of any type of trailer that is towed by a truck, semi truck, semi tractor trailer truck, or big rig truck. Trailer door or panel 100 may be any door or panel on the trailer. Trailer door or panel 100 has an interior surface and an exterior surface.

Smart display for trailer door or panel 5 is installed into a rectangular shaped hole or window 116 cut into any trailer door or panel 100. Smart display for trailer door or panel 5 is attached or clamped onto the rectangular shaped hole or window 116 with a portion of the smart display for trailer door or panel 5 passing through the rectangular shaped hole or window 116. Thus, a portion of smart display for trailer door or panel 5 is located on interior or inside the trailer and a portion of smart display for trailer door or panel 5 is located the exterior or outside of the trailer. Throughout this writing, the terms interior and exterior will be used, wherein interior represents the side or portion of the item that is adjacent to or closest to the interior of the trailer and exterior represents the side or portion of the item that is adjacent to or closest to the exterior of the trailer. Smart display for trailer door or panel 5 can be installed during production at the trailer plant or installed as an after-market product on any trailer. The trailer door or panel 100 and the trailer are not a part of smart display for trailer door or panel 5.

Smart display for trailer door or panel 5 comprises: a display screen 10; a cabinet 20; a computer 30; a retaining flange 50; and a plurality of bolts, studs, or rivets 60.

Display screen 10 is an assembly that includes one or more LED panels 16 with a plurality of LED lights 18 that function together to display the reproduction or live broadcasting of visual images or video content on the display screen 10. Display screen 10 can display advertisements including video advertisements and/or still frame advertisements, like a billboard on wheels travelling along the highways and roads all across the USA. Typically, the display screen 10 is attached to the back or rear of the trailer so that the display screen is easily viewed from drivers behind the trailer and is not a safety threat or a hazard to view and read from this angle.

Display screen 10 comprises: a frame 12; a frame mounting panel 14; and at least one LED panel 16.

Frame 12 is a rigid rectangular annulus shaped member or a rigid rectangular planar member with a rectangular shaped hole or void in the center to leave a rectangular shaped frame member similar to a rectangular picture fame. Frame 12 is a planar member. Frame 12 has a center, an exterior surface, an interior surface, a thickness, an outer width, an inner width, an outer length, and an inner length. The inner width and the inner length dimensions of frame 12 are the width and the length dimensions respectively of the display screen 10. The inner width and the inner length dimensions of frame 12 are also the width and length of the rectangular shaped hole or void in the trailer door or panel 100 into which the smart display for trailer door or panel 5 is installed. The outer width of frame 12 is about 1-10 feet. The outer length of frame 12 is about 2-20 feet. Frame 12 functions in tandem with retaining flange 50 to mechanically rigidly clamp onto the tailer door or panel 100 as described below. The exterior surface or the perimeter of frame 12 may have a gasket to help maintain an air-tight and water-tight connection between these members.

Frame 12 may be made of any known material such as: metal, steel, aluminum, polymer, plastic, composite, wood, fiberglass, ceramic, carbon fiber, or any other known material. In best mode, frame 12 is metal or steel.

Frame mounting panel 14 is a rigid planar member. Frame mounting panel 14 has a center, an interior surface, an exterior surface, a thickness, a width, and a length. The width and length of frame mounting panel are the same as or slightly larger the inner width and the inner length respectively of the frame 12. Frame mounting panel 14 functions as mounting surface to mount at least one LED panel 16 and various electronic components as described below. Frame mounting panel 14 includes a plurality of mounting holes that are used to help attach or mount LED panels 16 and various electronic components to frame mounting panel 14 as described below. Frame mounting panel 14 also includes a plurality of rectangular windows or clearance holes that provide clearance to attach electrical connectors or wires to the LED panel electrical connectors as described below. Frame mounting panel 14 may be made of any known material such as: metal, steel, aluminum, polymer, plastic, composite, wood, fiberglass, ceramic, carbon fiber, or any other known material. In best mode, frame mounting panel 14 is metal or steel. The exterior surface of frame mounting panel 14 is rigidly attached to the interior surface of frame 12 so that the center of frame 12 is concentric with that of frame mounting panel 14. Rigid attachment may be accomplished by any known means such as: brake bending, pressed seam, weld, solder, glue, epoxy, adhesive, bolts, screws, rivets, clips, snaps, pins, or fasteners. In best mode, rigid attachment is accomplished by welding. Thus, the assembly of frame 12 and frame mounting panel 14 is a two layer structure with frame 12 oriented toward the outside of the trailer door or panel 100 and frame mounting panel 14 oriented toward the inside of the trailer door or panel 100. As discussed below, this allows the exterior surface of each LED panel 16 to be flush with the outside surface of frame 12.

Frame mounting panel 14 may optionally further comprise a plurality of support ribs 15 on its interior surface. A support rib 15 is an elongated rigid member or linear support member that is rigidly attached to the interior surface of frame mounting panel 14. Typically, a set of support ribs 15 runs laterally across the full width of frame mounting panel 14 and another set of support ribs 15 runs longitudinally across the full length of the frame mounting panel 14. Support ribs 15 help stiffen or increases the rigidity the frame mounting panel 14 which helps secure the electronic components attached thereto as described below.

Each at least one LED panel 16 comprises a rigid rectangular planer member and a plurality of LED lights 18. Rigid rectangular planer member has a center, an exterior surface, an interior surface, a length and a width. Each LED light 18 is a light emitting diode (LED). A light-emitting diode (LED) is a semiconductor light source that emits light when electrical current flows through it. LED lights 18 may emit light in any color and at any brightness. Any known type of LED may be used for the LED lights 18. Each of the plurality of LED lights 18 is rigidly attached to the exterior surface of the rigid rectangular planer member of the LED panel 16. Each at least one LED panel 16 further comprises a plurality of LED panel electrical connectors located on the interior surface of the LED panel 16. Each LED panel electrical connector is an electromechanical device used to join electrical conductors and create an electrical circuit. Any known type of electrical connector can be used. Each of the plurality of LED lights 18 is connected to one or more of the plurality of LED panel electrical connectors by an electrical circuit or conductor so that there is electrical continuity between these members. Each at least one LED panel 16 further comprises a plurality of fastening studs that are rigidly attached to the interior surface of the LED panel. Each of the plurality of fastening studs is a rigid solid cylindrical member with a first end, a second end, an exterior surface, and a longitudinal axis. There is helical thread or male thread cut into the exterior surface of each fastening stud. The first end of each fastening stud is rigidly attached to the interior surface of the rigid rectangular planer member of the LED panel 16 so that the longitudinal axis of each fastening stud is perpendicular to the rigid rectangular planer member of the LED panel 16. The plurality of fastening studs functions to help reversibly rigidly attach the interior surface of each LED panel 16 to the exterior surface of the frame mounting panel 14. Each of the plurality of fastening studs is fed through a mounting hole in the frame mounting panel 14 and fastened to the frame mounting panel 14 with a nut fastener. Each at least one LED panel 16 is manufactured as a stand alone unit by an electronics manufacturer. East at least one LED panel 16 may be any known type of LED panel from any manufacturer. In best mode, display screen includes a plurality of LED panels 16 in order to yield a large and bright display screen 10.

Cabinet 20 comprises: a cabinet box 22 and at least one cabinet door 24. Cabinet box 22 is a solid rigid rectangular cuboid member or a hollow box-shaped member with an open bottom. Cabinet box 22 has an upper side, a lower side, a left side, a right side, an interior side, and an exterior side. The upper side, lower side, left side, right side, and interior side are solid rigid planar members. The upper side, lower side, left side, right side, and interior side are connected together to form the solid rigid rectangular cuboid member. The seams between the upper side, lower side, left side, right side, and interior side are sealed connections that are air-tight and water-tight in order to keep the electronic components contained within the cabinet 20 dry and protected from the elements. The exterior side is open and void. The interior side has at least one rectangular hole or window with a center, a width, and a length. At least one rectangular hole is reversibly covered by at least one cabinet door 24 as described below. Cabinet box 22 has a center, an inner width, an outer width, an inner length, an outer length, and a depth. The outer width and outer length of cabinet box 22 are the same as, slightly smaller than, or slightly larger than the inner width and inner length respectively of frame 12. The depth of cabinet 20 is about 1-12 inches. The open exterior side of cabinet box 22 is rigidly attached to the interior surface of frame 12 or the interior surface of frame mounting panel 14 so that the center of cabinet box 22 is concentric with that of frame 12 and frame mounting panel 14. The rigid attachment of the exterior side of cabinet box 22 to the interior surface of frame 12 or the interior surface of frame mounting panel 14 is a sealed connection that is an air-tight and water-tight barrier in order to keep the electronic components contained within cabinet 20 dry and protected from the elements. Rigid attachment may be accomplished by any known means such as: brake bending, pressed seam, weld, solder, glue, epoxy, adhesive, bolts, screws, rivets, clips, snaps, pins, or fasteners. In best mode, rigid attachment is accomplished by welding. Cabinet box 22 may be made of any known material such as: metal, steel, aluminum, polymer, plastic, composite, wood, fiberglass, ceramic, carbon fiber, or any other known material. In best mode, cabinet box 22 is metal or steel.

At least one cabinet door 24 is a rigid planar member with a center, an exterior surface, an interior surface, a lower half, an upper half, a width, a length, and a perimeter. Cabinet door 24 functions to cover the at least one rectangular hole or window in the interior side of cabinet 20. The width and length of at least one cabinet door 24 is slightly larger than those of at least one rectangular hole or window in the interior side of cabinet box 22. At least one cabinet door 24 is reversibly attached or pivotally attached to the interior side of cabinet box 22 so that at least one cabinet door 24 completely covers the at least one rectangular hole or window in the interior side of cabinet box 22 when attached or pivotally closed. In the case of pivotal attachment, there are two or more hinges connecting or pivotally attaching the at least one cabinet door 24 to the interior side of cabinet 20. The centers of at least one cabinet door 24 and at least one rectangular hole or window in the interior side of cabinet box 22 are concentric when at least one cabinet door 24 is attached or pivotally closed. When at least one cabinet door 24 is attached or pivotally closed there is a sealed connection between the at least one cabinet door 24 and the at least one rectangular hole or window in the interior side of cabinet box 22 that is air-tight and water-tight in order to keep the electronic components contained within the cabinet 20 dry and protected from the elements. The exterior surface or the perimeter of at least one cabinet door 24 may have a gasket to help maintain this air-tight and water-tight connection. As stated above the exterior surface is the surface that is adjacent to or closest to the exterior of the trailer. When the smart display for trailer door or panel 5 is installed properly into a trailer door or panel 100, at least one cabinet door 24 gives access to all of the electronics in the smart display for trailer door or panel 5 from the inside of the trailer. With this access, all electronics components including individual LED panels 16 may be easily checked and replaced.

At least one cabinet door 24 may further comprise: a lower vent 26, and an upper vent 27, and a fan 28. Vents 26,27 and fan 28 function in together in order to cool the interior of cabinet 20 as the smart display for trailer door or panel 5 is in operation. When smart display for trailer door or panel 5 is operating or running, the electronic components located or mounted within cabinet 20 produce a significant amount of heat. In order for the electronic components in the cabinet 20 to run properly for extended periods of time, the heat generated from the electronic components must be removed from the cabinet 20. Lower vent 26 is one or more holes, slots, or voids in the lower half of at least one cabinet door 24. Upper vent 27 is one or more holes, slots, or voids in the upper half of at least one cabinet door 24. Fan 28 is an apparatus with rotating blades that creates a current of air for cooling or ventilation. Any known type of fan may be used for fan 28. Fan 28 is rigidly attached to the upper half of at least one cabinet door 24 over upper vent 27. With this arrangement, fan 28 blows or pushes air from inside the cabinet 20 through upper vent 27 and out of the cabinet 20. The air that fan 28 blows out of the cabinet 20 at upper vent 27 is replaced by cooler air entering the cabinet through lower vent 26 on the lower half of cabinet door 24. Typically, fan 28 operates continuously when the smart display for trailer door or panel 5 is in operation.

At least one cabinet door 24 may further comprise an air box 29. Air box 29 is a baffle, shield, or cover attached to the exterior surface of at least one cabinet door 24 over the lower vent 26 as depicted. As stated above the exterior surface is the surface that is adjacent to or closest to the exterior of the trailer, which is on inside of cabinet 20 when at least one cabinet door 24 is closed. Air box 29 is a rectangular cuboid or box shaped member with an open top. Air box 29 functions to channel or direct upwards all the air being sucked or pulled in through lower vent 26 towards the electronic components inside cabinet 20. Air box 29 also functions to help shield the electronic components inside cabinet 20 from any water or other contaminants, such as sand and dust, that be sucked or pulled into the cabinet 20 through lower vent 26. The air flowing through lower vent 26 essentially runs into the air box 29 wherein any water or contaminants then strike the air box 29 and are drained or deflected downwards before the air flows upwards and onto the electronic components in cabinet 20. The bottom side of air box 29 is sloped downward to allow the water and contaminants to drain downward and out from the interior of the cabinet 20 and prevent any water from running into the cabinet 20.

Computer 30 is a digital electronic machine that can be programmed to carry out sequences of arithmetic or logical operations or computations automatically. Computer 30 can perform sets of operations known as software programs. Computer 30 has a special and proprietary software program which operates smart display for trailer door or panel 5 and causes the display screen 10 to display the reproduction or live broadcasting of visual images or video content on the display screen 10. Computer 30 is rigidly attached to the interior surface of frame mounting panel 14 as depicted. There are many types and models of computers being sold today. Computer 30 may be any known type of computer.

The computer 30 may optionally further comprise a wireless modem 32. Wireless modem 32 is a type of modem that allows a computer or a router to receive wireless Internet access via a mobile broadband connection instead of using telephone or cable television lines. A computer 30 with a wireless modem 32 can connect to a wireless Internet Service Provider (ISP) to get Internet access. Typically, wireless modem 32 is a component of computer 30. Any known type of wireless modem 32 can be used.

With these modes, the computer 30 can have a network connection to a mother computer or controlling computer. This mother computer or controlling computer could provide advertising content to the smart display for trailer door or panel 5, perform software maintenance and updates to the smart display for trailer door or panel 5, turn the display on and off on the smart display for trailer door or panel 5, monitor truck location, and as well as any other directive or type of communication.

Computer 30 may optionally further comprise a GPS tracking unit 34. GPS tracking unit 34 is a navigation device normally that uses the Global Positioning System (GPS) to determine its movement and determine its geographic position on the earth in order to determine its location. GPS tracking devices send special satellite signals that are processed by the GPS tracking unit 34 in order to determine the location of the GPS tracking unit 34. Typically, GPS tracking unit 34 is a component of computer 30. Any known type of GPS tracking unit 34 can be used.

Smart display for trailer door or panel 5 may further comprise a video processing module 36. Video processing module 36 is an electronic component with an integrated circuit that receives image signals or files from a computer or server and processes the image signals or files or performs a series of mathematical operations to the image signals or files and then sends the results or output to a video display or other electronic component. Video processing module 36 performs signal processing or image processing where the input and output signals are video files or video streams. Video processing module 36 is a standard off-the-shelf electronic component. Video processing module 36 is rigidly attached to the interior surface of frame mounting panel 14 as depicted. There are many types and models of video processing modules being sold today. Video processing module 36 may be any known type of video processing module.

Smart display for trailer door or panel 5 may further comprise a sending card or relay card module 38. Sending card or relay card module 38 is an electronic component with an integrated circuit that converts a low level control signal into a higher level load signal for input into a video display screen. Sending card or relay card 38 converts input video signal like HDMI or DVI signals from the video processing module 36 into a format that LED panel 16 can interpret. Sending card module 36 is a standard off-the-shelf electronic component. Sending card or relay card module 38 is rigidly attached to the interior surface of frame mounting panel 14 as depicted. There are many types and models of sending card or relay card modules being sold today. Sending card or relay card module 38 may be any known type of sending card or relay card module.

Smart display for trailer door or panel 5 may further comprise one or more LED panel power supplies 40. A LED panel power supply 40 is an electrical component that supplies power to one or more LED panels 16. LED panel power supply 40 receives input electrical power and converts it into output electrical power that may properly power one or more LED panels 16. Each LED panel power supply 40 may convert voltage and amperage of the input electrical power. One or more LED panel power supplies 40 are rigidly attached to the interior surface of frame mounting panel 14 as depicted. There are many types and models of power supply modules being sold today. One or more LED panel power supplies 40 may be any known type of power supply module that is compatible with the particular type of LED panel being used by smart display for trailer door or panel 5.

Smart display for trailer door or panel 5 may further comprise a power junction box 42. Power junction box 42 is an electrical component that supplies power to one or more electrical modules. Power junction box 42 receives input electrical power from the battery of the truck, semi truck, semi tractor trailer truck, or big rig truck and converts it into output electrical power that powers: the computer 30, the video processing module 36, the sending card or relay card module 38, and one or more LED panel power supplies 40. Power junction box 42 may convert direct current electrical power into alternating current electrical power. Power junction box 42 is rigidly attached to the interior surface of frame mounting panel 14 as depicted. There are many types and models of power junction boxes being sold today. Power junction box 42 may be any known type of power junction box that is compatible with the particular types of electronics being used by smart display for trailer door or panel 5.

Smart display for trailer door or panel 5 further comprises a plurality of electrical wiring or cable 44. Each of the plurality of electrical wiring or cable 44 is a length of electrical wire or cable that is a length of an electrical conductor material encased by an insulative cover. There are many types of electrical wire and cable on the market. Any known type of electrical wire or cable may be used. There is at least one length of electrical wiring or cable 44 connecting the battery on the truck, semi truck, semi tractor trailer truck, or big rig truck to the power junction box 42 so that there is electrical continuity between these members. There is at least one length of electrical wiring or cable 44 connecting the power junction box 42 to the computer 30 so that there is electrical continuity between these members. There is at least one length of electrical wiring or cable 44 connecting the power junction box 42 to the video processing module 36 so that there is electrical continuity between these members. There is at least one length of electrical wiring or cable 44 connecting the power junction box 42 to the sending card or relay card module 38 so that there is electrical continuity between these members. There is at least one length of electrical wiring or cable 44 connecting the power junction box 42 to each of the one or more LED panel power supplies 40 so that there is electrical continuity between these members. There is at least one length of electrical wiring or cable 44 connecting each of the at least one LED panels 16 to one or more LED panel power supplies 40 so that there is electrical continuity between these members. There is at least one length of electrical wiring or cable 44 connecting the computer 30 to each of the at least one LED panels 16 so that there is electrical continuity between these members. There is at least one length of electrical wiring or cable 44 connecting the computer 30 to the video processing module 36 so that there is electrical continuity between these members. There is at least one length of electrical wiring or cable 44 connecting the video processing module 36 to the sending card or relay card module 38 so that there is electrical continuity between these members. There is at least one length of electrical wiring or cable 44 connecting the sending card or relay card module 38 to at least one LED panels 16 so that there is electrical continuity between these members.

Thus, all of the above components are assembled together to form a display assembly. The display assembly comprises: the display screen 10 and the cabinet 20 with the computer 30, video processing module 36, sending card or relay card module 38, LED panel power supply 40, and power junction box 42 mounted on the frame mounting panel 14 and all electrical wiring or cable 44 electrically connecting all of the electronic components. The whole display assembly is mounted on the exterior surface of the trailer door or panel 100 and locked into place there by a retaining flange 50 and a plurality of bolts, studs, or rivets 60, as described below.

Retaining flange 50 is a rigid rectangular annulus shaped member or a rigid rectangular planar member with a rectangular shaped hole or void in the center to leave a rectangular shaped frame member similar to a rectangular picture fame. Retaining flange 50 is a planar member. Retaining flange 50 has a center, an exterior surface, an interior surface, a thickness, an outer width, an inner width, an outer length, and an inner length. The inner width and the inner length dimensions of retaining flange 50 are the same as the inner width and inner length respectively of frame 12. The outer width and the outer length dimensions of retaining flange 50 are the same as the outer width and outer length respectively of frame 12. Retaining flange 50 has a plurality of bolt, stud, or rivet holes 52. Each bolt, stud, or rivet hole 52 is a circular hole in retaining flange 50. Bolt, stud, or rivet holes 52 are evenly spaced around retaining flange 50. Each bolt, stud, or rivet hole 52 on retaining flange 50 provides a clearance hole for a bolt, stud, or rivet 60 as described below. Retaining flange 50 functions in tandem with frame 12 to mechanically rigidly clamp onto the tailer door or panel 100 as described below. The exterior surface or the perimeter of retaining flange 50 may have a gasket to help maintain an air-tight and water-tight connection between these members. As stated above the exterior surface is the surface that is adjacent to or closest to the exterior of the trailer. Retaining flange 50 may be made of any known material such as: metal, steel, aluminum, polymer, plastic, composite, wood, fiberglass, ceramic, carbon fiber, or any other known material. In best mode, frame 12 is metal or steel.

Each bolt, stud, or rivet 60 is a rigid cylindrical member is a rigid cylindrical member with a first end, a second end, an exterior surface, and a longitudinal axis. In the case of a bolt or stud, there is helical thread or male thread cut into the exterior surface of each bolt, stud, or rivet 60. In the case of a rivet, the exterior surface of each bolt, stud, or rivet 60 is smooth. The first end of each bolt, stud, or rivet 60 is attached to the interior surface of frame 12 or inserted into a hole on frame 12 so that the longitudinal axis of each bolt, stud, or rivet 60 is perpendicular to the plane of frame 12. A plurality of bolts, studs, or rivets 60 is evenly spaced around the entire frame 12. The plurality of bolts, studs, or rivets 60 functions to help reversibly rigidly attach the interior surface of frame 12 to the exterior surface of trailer door or panel 100 and the exterior surface of retaining flange 50 to the interior surface of trailer door or panel 100 by mechanically clamping or sandwiching the trailer door or panel 100 in between frame 12 and retaining flange 50. In best mode, there are a total of 16 bolts, studs, or rivets 60 used to reversibly rigidly attach smart display for trailer door or panel 5 to the trailer door or panel 100.

Smart display for trailer door or panel 5 is installed onto a trailer door or panel 100 as follows. A rectangular hole or window 116 is cut into the trailer door or panel 100. The whole display assembly is then placed over the exterior surface of the trailer door or panel 100 where the cabinet 20 and the at least one cabinet door 24 are inserted through the rectangular hole or window 116 so that the at least one cabinet door 24 penetrates the rectangular hole or window 116 and extends beyond the interior surface of the trailer door or panel 100. Then retaining flange 50 is placed on the interior surface of trailer door or panel 100 and aligned to coincide with frame 12. Then, a bolt, stud, or rivet 60 is inserted through each bolt, stud, or rivet hole 52 in retaining flange 50, wherein the bolt, stud, or rivet 60 is tightened or fastened to tightly clamp frame 12 and retaining flange 50 together thereby clamping onto the trailer door or panel 100 in between to reversibly rigidly attach the smart display for trailer door or panel 5 onto the trailer door or panel 100. In the case of a bolt or stud, a retaining flange nut 54 is installed and tightened down onto each bolt, stud, or rivet hole 52 in retaining flange 50. In the case of a rivet, the rivet is squeezed or processed, in the usual way to install a rivet, to tightly clamp frame 12 and retaining flange 50 together. Next, the power junction box 42 must be electrically connected to the battery in the truck, semi truck, semi tractor trailer truck, or big rig truck. Then the smart display for trailer door or panel 5 is properly installed and ready to display advertisements. As discussed, the computer 30 may have a wireless network connection to a central computer or a mother server which can fully operate and initialize, program, update, upgrade, and monitor the smart display for trailer door or panel 5 without any action or thinking taken by the owner or driver of the truck, semi truck, semi tractor trailer truck, or big rig truck. Smart display for trailer door or panel 5 may be removed as necessary from the trailer door or panel 100 by electrically disconnecting the power junction box 42 and then unfastening or cutting the plurality of bolt, stud, or rivet holes 52 to remove the whole display assembly.

What is claimed is:

1. A smart display for trailer door or panel comprising: a display screen; a cabinet; a computer; a plurality of electrical wiring or cable; a retaining flange; and a plurality of bolts, studs, or rivets, wherein said display screen comprises: a frame, a frame mounting panel, and at least one LED panel, wherein said frame is rigid rectangular annulus shaped planar member or a rigid rectangular planar member with a rectangular shaped hole or void therein, said frame has a center, an exterior surface, an interior surface, a thickness, an outer width, an inner width, an outer length, and an inner length, said frame mounting panel is a rigid planar member with a center, an interior surface, an exterior surface, a thickness, a width, and a length, said frame mounting panel has a plurality of mounting holes and a plurality of rectangular windows or clearance holes, said exterior surface of frame mounting panel is rigidly attached to said interior surface of frame so that said center of said frame is concentric with said center of said frame mounting panel, at least one LED panel comprises: a rigid rectangular planer member, a plurality of LED lights, and a plurality of LED panel electrical connectors, said rigid rectangular planer member of said at least one LED panel has a center, an exterior surface, an interior surface, a length and a width, each of said plurality of LED lights is a light emitting diode or a semiconductor light source that emits light when electrical current flows through said semiconductor light source, each of said plurality of LED lights is rigidly attached to said exterior surface of said rigid planar member of said at least one LED panel, each of said plurality of LED panel electrical connectors is an electromechanical device used to join electrical conductors and create an electrical circuit, each of said plurality of LED lights is connected to one or more of said plurality of LED panel electrical connectors by an electrical circuit or conductor so that there is electrical continuity there between, said interior surface of each of said at least one LED panel is reversibly rigidly attached to said exterior surface of said frame mounting panel, said cabinet comprises: a cabinet box and at least one cabinet door, said cabinet box is a solid rigid rectangular cuboid member or a hollow box-shaped member with an open bottom, said cabinet box has an upper side, a lower side, a left side, a right side, an interior side, and an exterior side, said upper side, said lower side, said left side, said right side, and said interior side of said cabinet box are solid rigid planar members, said exterior side of said cabinet box is open and void, said interior side of said cabinet box has at least one rectangular hole or window with a center, a width, and a length, said cabinet box has a center, an inner width, an outer width, an inner length, an outer length, and a depth, said exterior side of said cabinet box is rigidly attached to said interior surface of said frame or said interior surface of said frame mounting panel so that said center of said cabinet box is concentric with said center of said frame and said center of frame mounting panel, said at least one cabinet door is a rigid planar member with a center, an exterior surface, an interior surface, a lower half, an upper half, a width, a length, and a perimeter, said at least one cabinet door is reversibly attached or pivotally attached to said interior side of said cabinet box so that said at least one cabinet door completely covers said at least one rectangular hole or window in said interior side of said cabinet box, said computer is digital electronic machine that can be programmed to carry out sequences of arithmetic or logical operations or computations automatically, said computer is rigidly attached to said interior surface of said frame mounting panel, each of said plurality electrical wiring or cable is a length of electrical wire or cable that is a length of an electrical conductor material encased by an insulative cover, wherein there is at least one length of electrical wiring or cable connecting said computer to each of said at least one LED panels so that there is electrical continuity there between, said retaining flange is a rigid rectangular annulus shaped member or a rigid rectangular planar member with a rectangular shaped hole or void, said retaining flange has a center, an exterior surface, an interior surface, a thickness, an outer width, an inner width, an outer length, and an inner length, said retaining flange has a plurality of bolt, stud, or rivet holes, each of said plurality of bolts, studs, or rivets is a rigid cylindrical member is a rigid cylindrical member with a first end, a second end, an exterior surface, and a longitudinal axis, and each of said plurality of bolts, studs, or rivets is inserted through each of said plurality of bolt, stud, or rivet holes in said retaining flange and tightened or fastened to clamp said frame and said retaining flange together.

2. A smart display for trailer door or panel as recited in claim 1, wherein said computer further comprises a wireless modem that is a type of modem that allows a computer or a router to receive wireless Internet access via a mobile broadband connection.

3. A smart display for trailer door or panel comprising: a display screen; a cabinet; a computer; a video processing module; a sending card or relay card module; a plurality of electrical wiring or cable; a retaining flange; and a plurality of bolts, studs, or rivets, wherein said display screen comprises: a frame, a frame mounting panel, and at least one LED panel, wherein said frame is rigid rectangular annulus shaped planar member or a rigid rectangular planar member with a rectangular shaped hole or void therein, said frame has a center, an exterior surface, an interior surface, a thickness, an outer width, an inner width, an outer length, and an inner length, said frame mounting panel is a rigid planar member with a center, an interior surface, an exterior surface, a thickness, a width, and a length, said frame mounting panel has a plurality of mounting holes and a plurality of rectangular windows or clearance holes, said exterior surface of frame mounting panel is rigidly attached to said interior surface of frame so that said center of said frame is concentric with said center of said frame mounting panel, at least one LED panel comprises: a rigid rectangular planer member, a plurality of LED lights, and a plurality of LED panel electrical connectors, said rigid rectangular planer member of said at least one LED panel has a center, an exterior surface, an interior surface, a length and a width, each of said plurality of LED lights is a light emitting diode or a semiconductor light source that emits light when electrical current flows through said semiconductor light source, each of said plurality of LED lights is rigidly attached to said exterior surface of said rigid planar member of said at least one LED panel, each of said plurality of LED panel electrical connectors is an electromechanical device used to join electrical conductors and create an electrical circuit, each of said plurality of LED lights is connected to one or more of said plurality of LED panel electrical connectors by an electrical circuit or conductor so that there is electrical continuity there between, said interior surface of each of said at least one LED panel is reversibly rigidly attached to said exterior surface of said frame mounting panel, said cabinet comprises: a cabinet box and at least one cabinet door, said cabinet box is a solid rigid rectangular cuboid member or a hollow box-shaped member with an open bottom, said cabinet box has an upper side, a lower side, a left side, a right side, an interior side, and an exterior side, said upper side, said lower side, said left side, said right side, and said interior side of said cabinet box are solid rigid planar members, said exterior side of said cabinet box is open and void, said interior side of said cabinet box has at least one rectangular hole or window with a center, a width, and a length, said cabinet box has a center, an inner width, an outer width, an inner length, an outer length, and a depth, said exterior side of said cabinet box is rigidly attached to said interior surface of said frame or said interior surface of said frame mounting panel so that said center of said cabinet box is concentric with said center of said frame and said center of frame mounting panel, said at least one cabinet door is a rigid planar member with a center, an exterior surface, an interior surface, a lower half, an upper half, a width, a length, and a perimeter, said at least one cabinet door is reversibly attached or pivotally attached to said interior side of said cabinet box so that said at least one cabinet door completely covers said at least one rectangular hole or window in said interior side of said cabinet box, said computer is digital electronic machine that can be programmed to carry out sequences of arithmetic or logical operations or computations automatically, said computer is rigidly attached to said interior surface of said frame mounting panel, said video processing module is an electronic component with an integrated circuit that receives image signals or files from said computer and processes said image signals or files or performs a series of mathematical operations to said image signals or files and then sends a set of results or output to said display screen, said sending card or relay card module is an electronic component with an integrated circuit that converts a low level control signal into a higher level load signal for input into said display screen, each of said plurality electrical wiring or cable is a length of electrical wire or cable that is a length of an electrical conductor material encased by an insulative cover, wherein there is at least one length of electrical wiring or cable connecting said computer to said video processing module so that there is electrical continuity there between, there is at least one length of electrical wiring or cable connecting said video processing module to said sending card or relay card module so that there is electrical continuity there between, there is at least one length of electrical wiring or cable connecting said sending card or relay card module to each of said at least one LED panels so that there is electrical continuity there between, said retaining flange is a rigid rectangular annulus shaped member or a rigid rectangular planar member with a rectangular shaped hole or void, said retaining flange has a center, an exterior surface, an interior surface, a thickness, an outer width, an inner width, an outer length, and an inner length, said retaining flange has a plurality of bolt, stud, or rivet holes, each of said plurality of bolts, studs, or rivets is a rigid cylindrical member is a rigid cylindrical member with a first end, a second end, an exterior surface, and a longitudinal axis, and each of said plurality of bolts, studs, or rivets is inserted through each of said plurality of bolt, stud, or rivet holes in said retaining flange and tightened or fastened to clamp said frame and said retaining flange together.

4. A smart display for trailer door or panel as recited in claim 3, wherein said computer further comprises a wireless modem that is a type of modem that allows a computer or a router to receive wireless Internet access via a mobile broadband connection.

* * * * *